US007723592B1

(12) United States Patent
Dixson, Jr.

(10) Patent No.: US 7,723,592 B1
(45) Date of Patent: May 25, 2010

(54) DRUM SPUR EXTENSION APPARATUS

(76) Inventor: Arthur E. Dixson, Jr., 357 Taulman Rd., Orange, CT (US) 06477

( * ) Notice: Subject to any disclaimer, the term of this patent is extended or adjusted under 35 U.S.C. 154(b) by 0 days.

(21) Appl. No.: 12/264,489

(22) Filed: Nov. 4, 2008

(51) Int. Cl.
*G10D 13/02* (2006.01)

(52) U.S. Cl. ..... 84/411 R

(58) Field of Classification Search ..... 84/411 R, 84/421, 280, 281
See application file for complete search history.

(56) References Cited

U.S. PATENT DOCUMENTS 1,711,708 A * 5/1929 Westermann, Jr. ..... 84/280
2,498,459 A * 2/1950 Schroetter ..... 84/280
3,541,914 A * 11/1970 Thompson ..... 84/421
4,829,874 A 5/1989 Hoshino
2006/0005689 A1 1/2006 Ito

* cited by examiner

*Primary Examiner*—Kimberly R Lockett
(74) *Attorney, Agent, or Firm*—Raymond A. Nuzzo

(57) ABSTRACT

A drum spur extension apparatus having an elongate member having a predetermined length, a longitudinally extending axis and a longitudinally extending inner bore that is sized for receiving a drum spur. The elongate member has a closed end and an opposite open end defining an opening in communication with the longitudinally extending bore. Other embodiments of the spur extension apparatus of the present invention are disclosed herein.

8 Claims, 4 Drawing Sheets

Fig 1
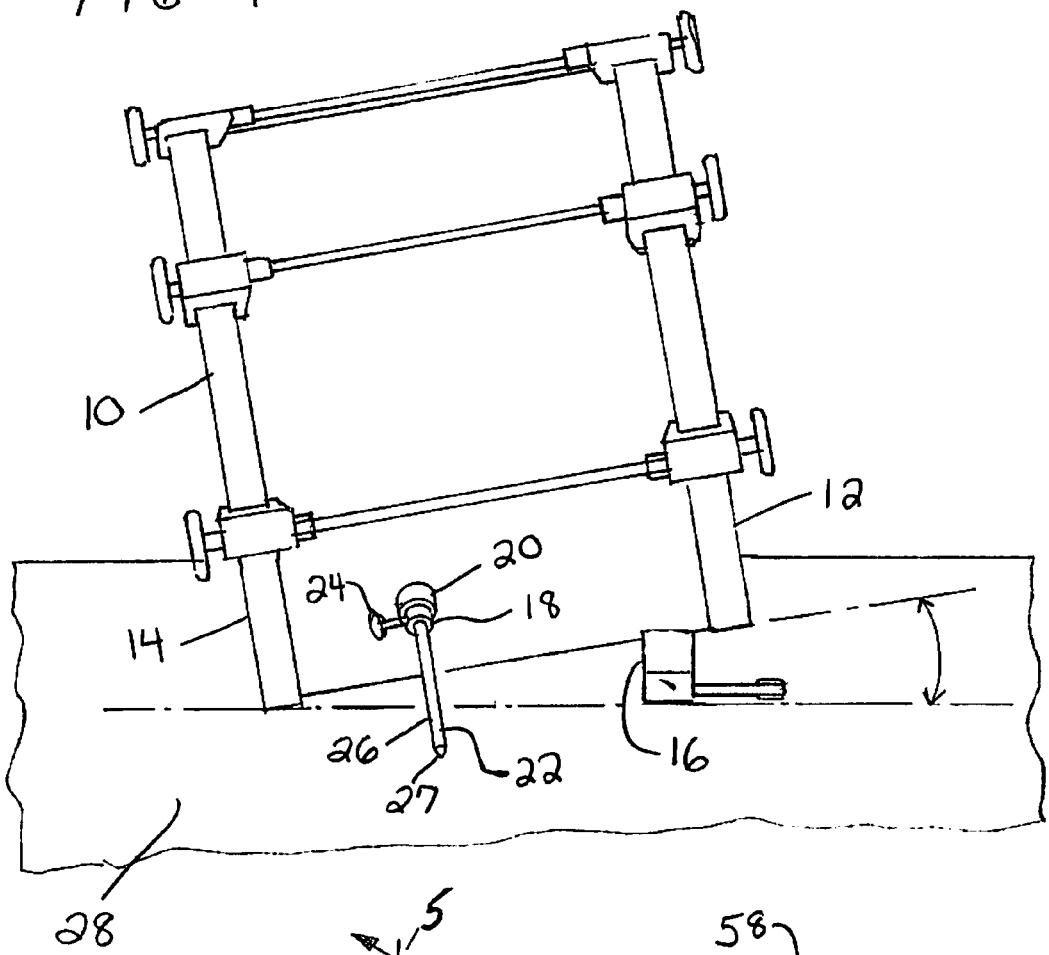
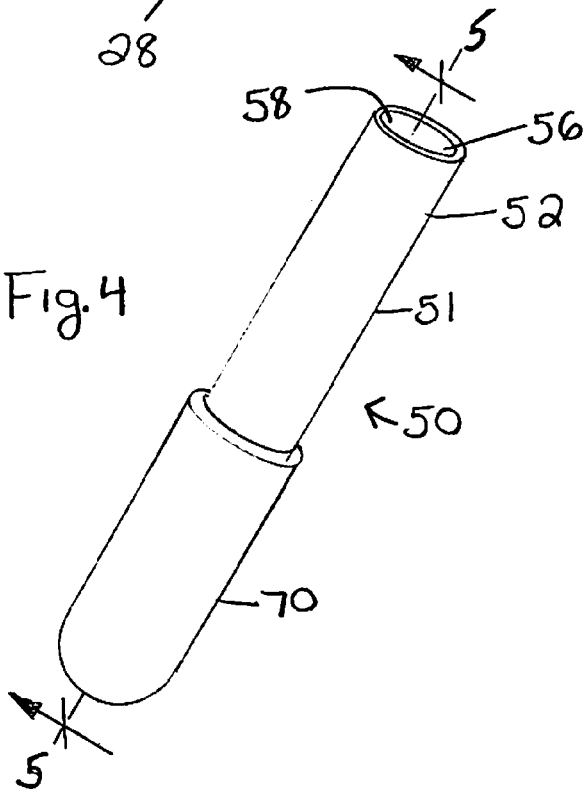
Fig.4
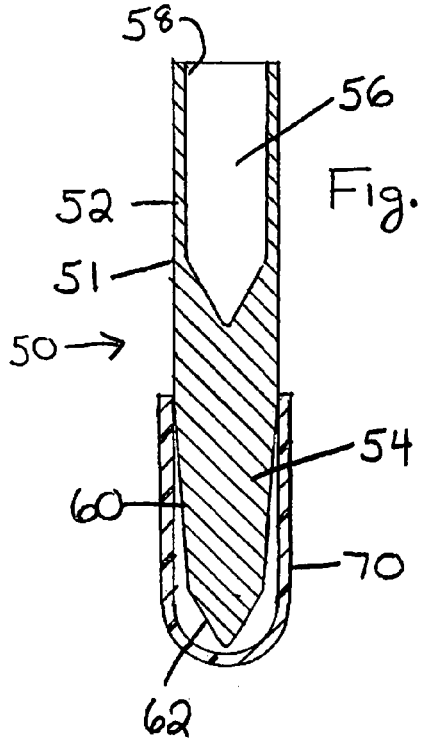
Fig.5

Fig. 3
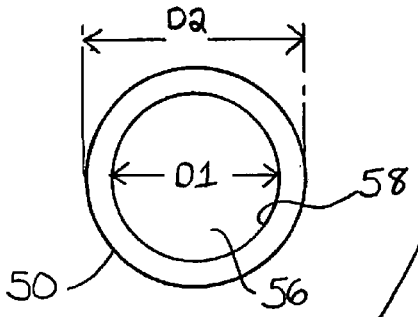
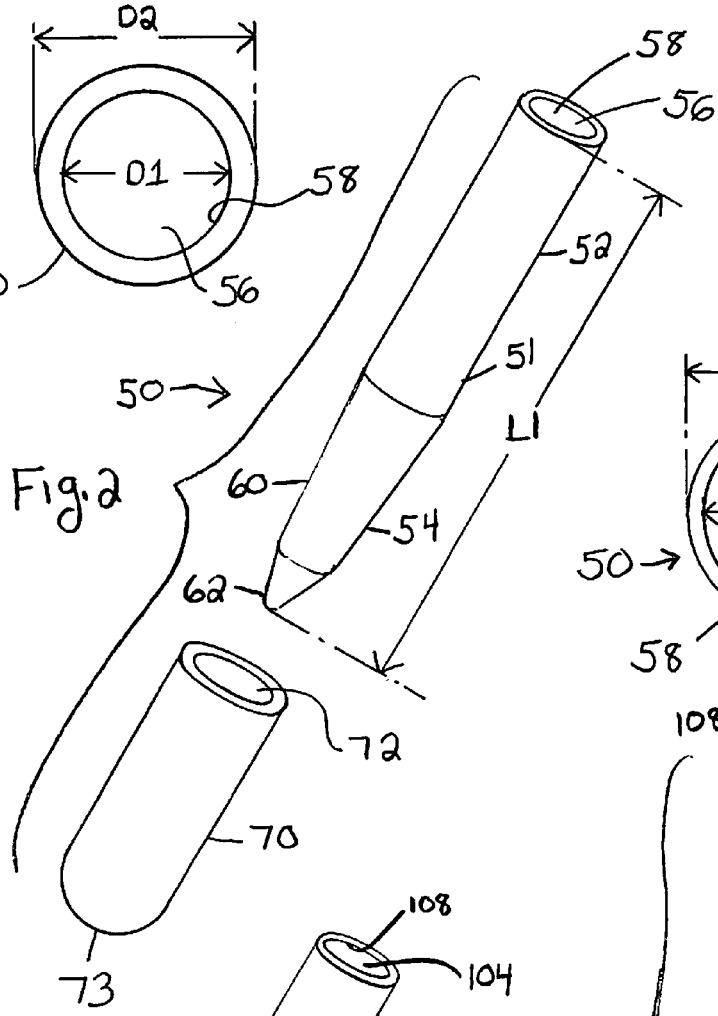
Fig. 2
Fig. 7
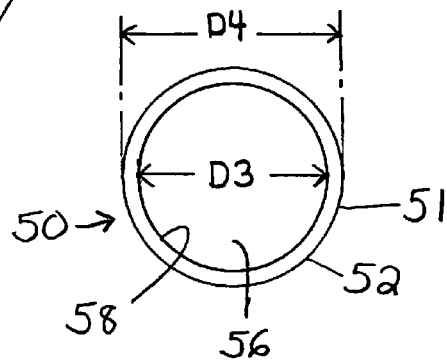
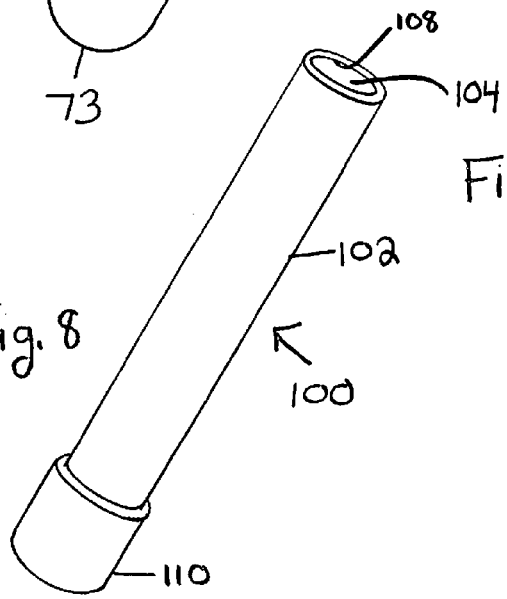
Fig. 8
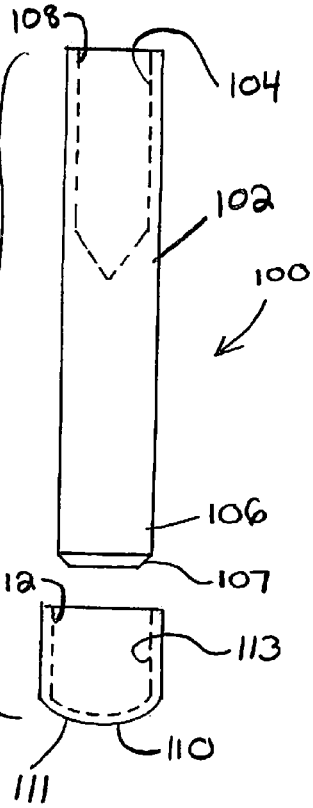
Fig. 6

DRUM SPUR EXTENSION APPARATUS

CROSS-REFERENCE TO RELATED APPLICATIONS

None.

TECHNICAL FIELD

The present invention generally relates to a drum spur extension apparatus.

BACKGROUND ART

Bass drums are known in the art and are widely used by musicians all over the world. Bass drums are typically used with foot pedal assemblies which comprise a hammer or beater that strikes the drumhead of the bass drum when a user depresses a foot pedal. Typical foot-operated pedals for use with bass drums are disclosed in U.S. Pat. No. 5,565,637, entitled "Foot Pedal for A Drum", issued to Shigenaga, and U.S. Pat. No. 4,567,808, entitled "Foot Operated Bass Drum Pedal", issued to Smith. It is imperative that the bass drum is in the correct or desired position so the hammer strikes the drumhead at the desired location. Lifts devices have been developed to position the bass drum in the desired position. Such devices are described in U.S. Pat. No. 4,829,874 and U.S. Patent Application Publication No. US2006/0005689. Another such device is disclosed in commonly owned and copending U.S. application Ser. No. 11/805,922, entitled "Drum Lift". These devices are located under the rear portion of the bass drum and raise the position of the drum beating spot to a desired height. Bass drums also include a spur which is typically adjustable and located toward the front area of the base drum. Specifically, the spur is slidably disposed within a spur mount attached to the drum and has a first portion within the spur mount and/or the interior of the bass drum, and a second portion that extends from the spur mount and contacts the surface, e.g. floor, upon which the bass drum is positioned. The spur can be pulled outward to increase the length of the portion of the spur that extends from the spur mount so as to raise the front portion of the bass drum. The spur can also be pushed inward so as to reduce the portion of the spur that extends from the mount thereby lowering the height of the front portion of the bass drum. However, early model bass drum spurs and some current bass drum spurs are limited in that they cannot raise the front portion of the bass drum to the appropriate height when certain types of drum lifts are used with the bass drum. Thus, in some instances, the drum will be at an awkward slant while the player is playing the bass drum. Such a slant in the bass drum's position could have a degrading effect on the sound produced by the drum.

What is needed a drum spur extension device that addresses the foregoing problems.

DISCLOSURE OF THE INVENTION

The present invention is directed to a drum spur extension apparatus. The drum spur extension apparatus comprises an elongate member having a predetermined length, a longitudinally extending axis and a longitudinally extending inner bore that is sized for receiving a drum spur. The elongate member has a closed end and an open end which defines an opening in communication with the longitudinally extending inner bore.

In one embodiment, the drum spur extension apparatus comprises a tip member that is attached to the closed end of the elongate member. In one embodiment, the tip member has an inner bore sized to frictionally receive the closed end of the elongate member.

Further, embodiments, features and advantages of the present invention are disclosed in the ensuing description.

BRIEF DESCRIPTION OF THE DRAWINGS

The present invention will be more readily understandable from a consideration of the accompanying drawings, wherein:

FIG. 1 is a side view of a bass drum with an existing drum spur;

FIG. 2 is an exploded view, in perspective, of a drum spur extension apparatus in accordance with one embodiment of the present invention;

FIG. 3 is a top plan view of the drum spur extension apparatus of FIG. 2;

FIG. 4 is a perspective view of the drum spur extension apparatus of FIG. 2 completely assembled;

FIG. 5 is a cross-sectional view taken along line 5-5 in FIG. 4;

FIG. 6 is an exploded view of a drum spur extension apparatus in accordance with another embodiment of the present invention;

FIG. 7 is a top plan view of the drum spur extension apparatus of FIG. 6;

FIG. 8 is a perspective view of the drum spur extension apparatus of FIG. 6 completely assembled;

BEST MODE FOR CARRYING OUT THE INVENTION

Figure 9:
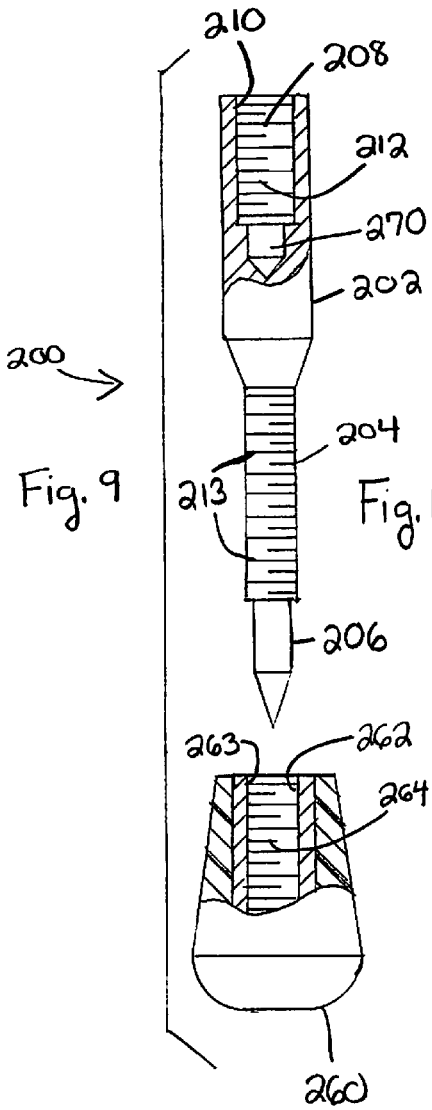
FIG. 9 is an elevation view, partially in cross-section, of a drum spur extension apparatus in accordance with a further embodiment of the present invention.

Referring to FIG. 1, there is shown bass drum 10 which has a rear portion 12 and a front portion 14. Drum lift 16 is positioned under rear portion 12. Drum lift 16 could be almost any type of drum lift such as those disclosed in U.S. Pat. No. 4,829,874 and co-pending and commonly owned U.S. application Ser. No. 11/805,922, entitled "Drum Lift". Bass drum 10 includes drum spur device 18 which includes mount 20 and spur 22. Spur 22 is slidably positioned within mount 20 and is held in a particular position by lug 24 that is engaged with mount 20. Spur 22 has a lower portion 26 that has a tip 27. Tip 27 contacts the surface 28 (e.g. floor, carpet, etc.) upon which bass drum 10 is positioned. As shown in FIG. 1, bass drum 10 is tilted an awkward angle since spur 22 is not long enough to raise front portion 14 to the appropriate height so as to position bass drum 10 at a substantially level orientation.

Referring to FIGS. 2 and 3, there is shown drum spur extension apparatus 50 in accordance with one embodiment of the invention. For purposes of brevity, the phrase "drum spur extension apparatus", which refers to the present invention, shall be referred to herein as "spur extension". Spur extension 50 comprises elongate member 51. Elongate member 51 comprises section 52 and section 54. Section 52 is generally cylindrical in shape and has inner bore 56 and opening 58. Opening 58 is in communication with bore 56. Bore 56 has diameter D1 that provides bore 56 with a size for receiving end portion 26 of existing spur 22 (see FIG. 1). Section 52 has outer diameter D2 that is sufficient to provide sufficient structural integrity to spur extension 50. It is to be understood that inner diameter D1 and outer diameter D2 may be varied depending on the size of existing spur 22 of bass drum 10 as well as the materials from which spur extension 50 is made. Section 54 comprises a generally tapered portion 60 that extends to tip 62.

Referring to FIGS. 2, 4 and 5, in a preferred embodiment, spur extension 50 includes tip portion 70 that is mounted to section 54 of spur extension 50. Tip portion 70 is hollow and has opening 72 that is in communication with interior of tip portion 70. The interior of tip portion 70 is sized to frictionally receive section 54. The degree of friction prevents tip portion 70 from sliding off of section 54. The bottom 73 of tip portion 70 contacts surface 28 upon which the base drum is located (see FIG. 1).

Sections 52 and 54 may be fabricated from a variety of materials, e.g. metal, plastic, resin, composite materials, etc. Tip portion 70 can be fabricated from suitable materials, e.g. plastic, rubber, etc. The length L1 (see FIG. 2) of spur extension 50 may be varied depending upon the length of the existing spur 22 (see FIG. 1).

In order to attach spur extension 50 to spur 22 (see FIG. 1), the user grasps spur extension 50 and inserts pre-existing spur 22 of bass drum 10 into bore 56 of section 52. If necessary, the user may use lug 24 to make fine adjustments to the length of the portion of spur 22 that extends from mount 20 in order to ensure the bass drum 10 is substantially level.

Referring to FIGS. 6, 7 and 8, there is shown spur extension 100 in accordance with another embodiment of the present invention. Spur extension 100 comprises elongate member 102. Elongate member 102 is substantially cylindrical in shape and has inner bore 104 and end portion 106. In one embodiment, end portion 106 has bevelled end 107. Elongate member 102 has opening 108 that is in communication with bore 104. Bore 104 has a diameter D3 that provides bore 104 with a size for receiving a portion of drum spur 22. Outer diameter D4 is sufficient to provide spur extension 100 with sufficient structural integrity. It is to be understood that inner diameter D3 and outer diameter D4 may be varied depending on the size of spur 22 and the materials from which spur extension 100 is made. In one embodiment, spur extension 100 includes tip 110. Tip 110 has bottom portion 111 that contacts the floor or surface (e.g. surface 28 shown in FIG. 1) upon which the bass drum is positioned. Tip 110 has an interior region 112 that is sized to receive end portion 106 of elongate member 102. Interior region 112 is specifically sized so as to create a frictional relationship between end portion 106 and the interior walls 113 extending about interior region 112 so as to prevent tip 110 from falling off end portion 106. Tip 110 can be fabricated from a variety of materials, e.g. rubber, plastic, resin, metal, etc. In a preferred embodiment, tip 110 is made from a material that would provide friction when it contacted the surface upon which the base drum was positioned.

In order to attach spur extension 100 to spur 22 (see FIG. 1), the user grasps spur extension 100 and inserts pre-existing spur 22 of bass drum 10 into bore 104 of section 102. If necessary, the user may use lug 24 to make fine adjustments to the length of the portion of spur 22 that extends from mount 20 in order to ensure the bass drum 10 is substantially level.

Figure 10:
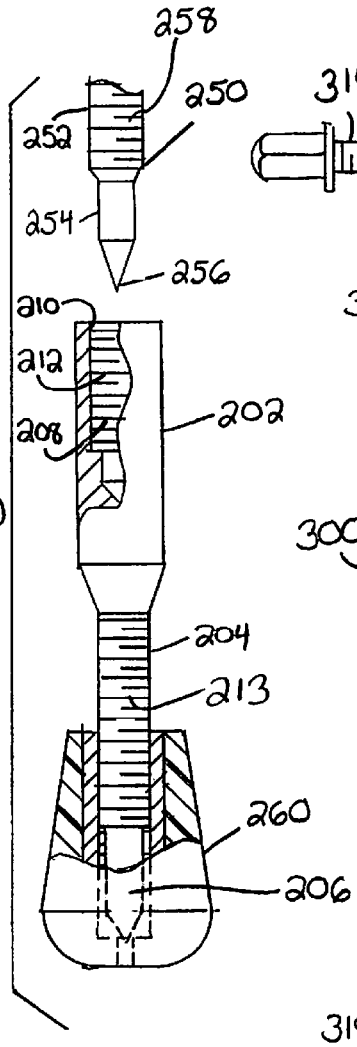
FIG. 10 is an exploded view, partially in cross-section, showing how the drum spur extension apparatus of FIG. 9 is connected to a pre-existing drum spur.

Referring to FIGS. 9 and 10, there is shown spur extension 200 in accordance with a further embodiment of the present invention. Spur extension 200 comprises upper section 202, intermediate section 204 and lower section 206. Upper section 202 has an inner bore 208 and opening 210 which is in communication with inner bore 208. Upper section 202 has internal threads 212 that extend about inner bore 208. Intermediate section 204 has an outer diameter that is less than the outer diameter of upper section 202. Intermediate section 204 includes external threads 213, the purpose of which is discussed in the ensuing description. Spur extension 200 is configured to be used with drum spur 250 that is part of a bass drum. A portion of drum spur 250 is shown in FIG. 10. Drum spur 250 comprises section 252 and lower section 254. Lower section 254 extends to tip 256. Section 252 includes external threads 258. In order to attach drum spur 250 to spur extension 200, tip 256 and a portion of section 252 is inserted into inner bore 208 of spur extension 200. A user then rotates spur extension 200 so that external threads 258 of drum spur 250 engage internal threads 212. The user continues to rotate spur extension apparatus 200 until it can no longer be rotated. As shown in FIG. 9, inner bore 208 has a lower portion 270 that has a shape that matches lower portion 254 of drum spur 250. In a preferred embodiment, spur extension 200 includes tip cover member 260. Tip cover member 260 has inner bore 262, opening 263 and internal threads 264 that extend about inner bore 262. In order to attach tip cover member 260 to lower section 206 of spur extension 200, a user inserts lower section 206 into opening 263 and inner bore 262 of tip cover member 260 and then rotates tip cover member 260 so that external threads 213 of intermediate section 204 engage internal threads 264 of tip cover member 260. The user continues to rotate tip cover member 260 until it cannot rotate further.

As with the previous embodiments of the present invention, spur extension 200 can be fabricated from any one of a variety of materials, e.g. plastic, metal, composite materials, rubber, resin, etc.

Figure 11:
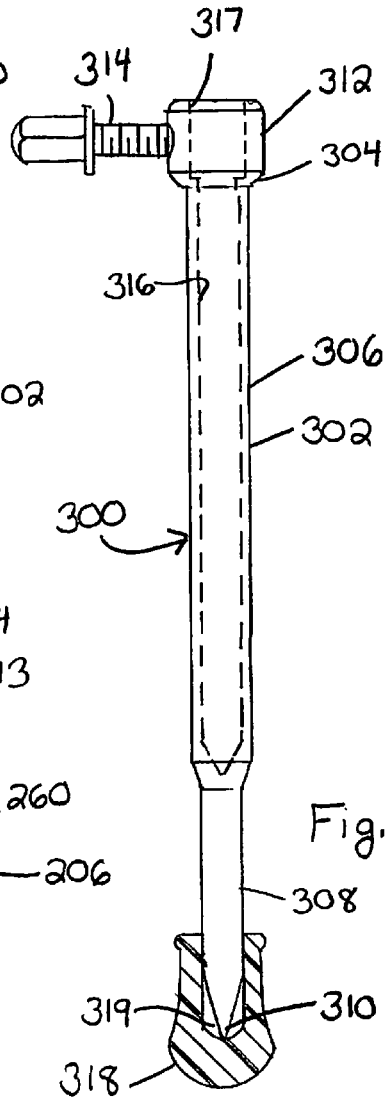
FIG. 11 is a side view, in elevation, of a drum spur extension apparatus in accordance with a further embodiment of the present invention.
Figure 12:
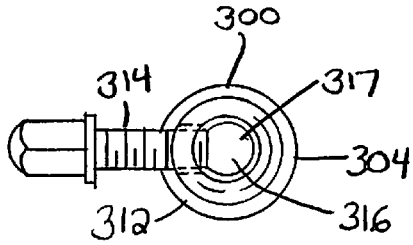
FIG. 12 is a top plan view of the drum spur extension apparatus of FIG. 11.

Referring to FIGS. 11 and 12, there is shown spur extension apparatus 300 in accordance with a further embodiment of the present invention. Spur extension 300 comprises elongate member 302 that has upper section 304, intermediate or shaft section 306 and lower portion 308. Lower portion 308 extends to tip 310. Upper section 304 comprises rim 312 and lug or screw 314 that is threadedly engaged to rim 312. Spur extension 300 includes internal bore 316 that extends throughout upper section 304 and intermediate section 306. Internal bore 316 is sized to receive a portion of an existing drum spur. Rim 312 has an opening 317 (see FIG. 12) that is in communication with internal bore 316. Lug 314 can rotate in one direction which causes a portion of lug 314 to extend into internal bore 316. Lug 314 can also rotate in an opposite direction that causes the aforesaid portion of lug 314 to be withdrawn from internal bore 316 so that no portion of lug 314 extends into bore 316. In one embodiment, tip cover 318 is removably attached to tip 310 and a portion of lower portion 308. Tip cover 318 is configured to have an internal bore 319 that is sized to frictional receive tip 310. In order to removably attached spur extension 300 to an existing drum spur, the user positions the tip of the existing drum spur into opening 317 of spur extension 300 and then slides spur extension 300 upon the shaft of the existing drum spur (e.g. spur 22 in FIG. 1). When spur extension 300 is at a desired position upon the shaft of the drum spur, the use then tightens lug 314 so that the lug 314 contacts the portion of the drum spur that is within rim 312 thereby preventing movement of spur extension 300 with respect to the drum spur. Thus, lug 314 prevents spur extension 300 from sliding off of the drum spur. A hand tool, such as a drum key, small wrench or pliers, can be used to tighten lug 314. In an alternate embodiment, lug 314 is replaced by a wing nut or any other suitable fastening device that, when screwed into rim 312, prevents movement of spur extension 300 with respect to the drum spur, thereby preventing spur extension 300 from sliding off of the drum spur.

As with the previous embodiments of the present invention, spur extension 300 can be fabricated from any one of a variety of materials, e.g. plastic, metal, composite materials, rubber, resin, etc.

Figure 13:
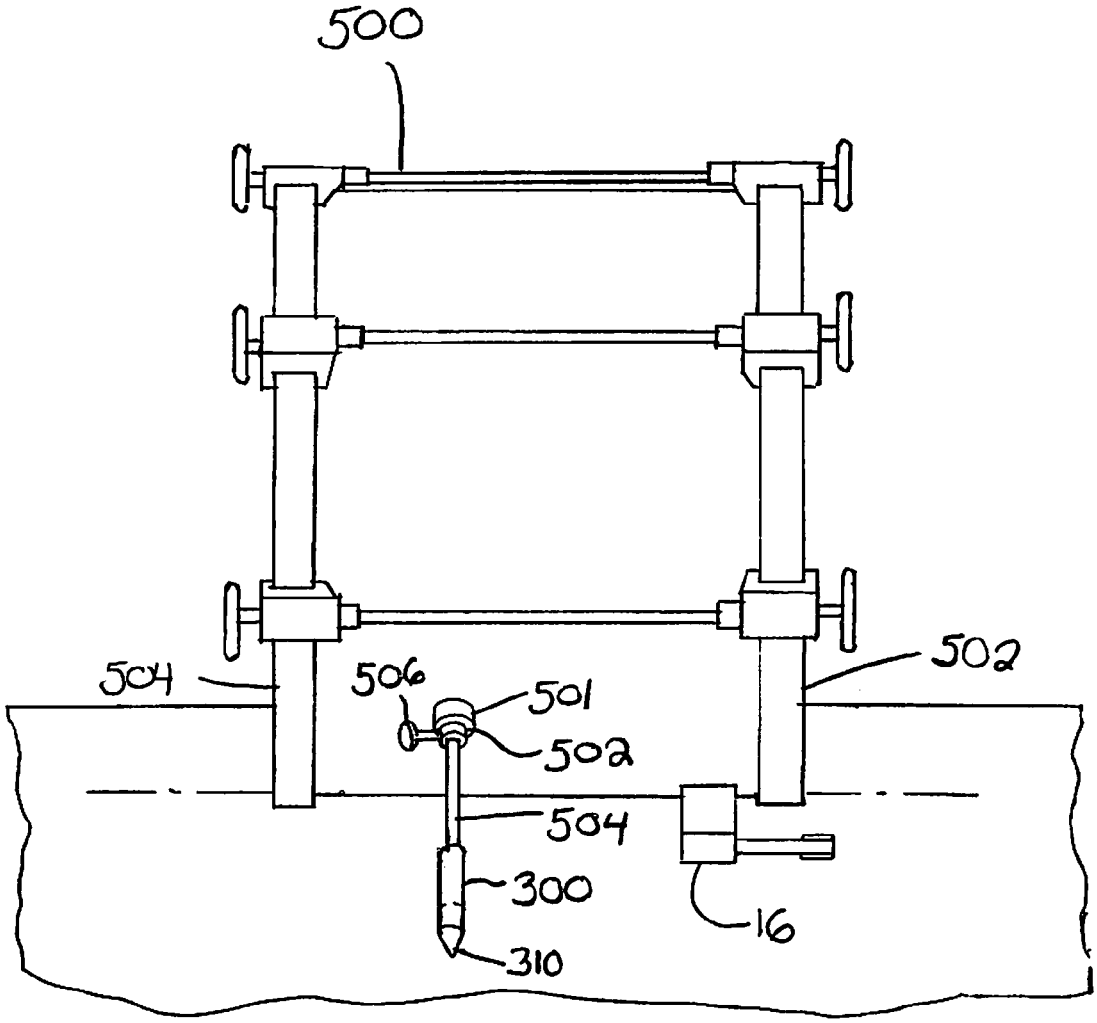
FIG. 13 is a side view of a bass drum using the drum spur extension apparatus of FIG. 11.

Referring to FIG. 13, there is shown bass drum 500 which has rear portion 502 and front portion 504. Drum lift 16 is positioned under rear portion 502. Drum lift 16 is shown in FIG. 1 and was described in the foregoing description. Bass drum 500 includes spur device 501 which comprises mount 502, spur 504 and lug 506. Spur extension 300 is removably mounted to spur 504. Specifically, a portion of spur 504 is disposed within bore 316 of spur extension 300 and lug 314 is tightened so as to prevent spur extension 300 from sliding off of spur 504. The user can make adjustments to the combined length of spur 504 and spur extension 300 by adjusting how much of the spur 504 is to be positioned within bore 316. For example, the overall combined length of spur 504 and spur extension 300 can be decreased by positioning more of spur 504 in internal bore 316. The overall combined length of spur 504 and spur extension 300 can be increased by reducing the portion of spur 504 that is located within internal bore 316. As shown in FIG. 13, spur extension 300 is adjusted so that bass drum 500 is substantially level.

In an alternate embodiment, spur extension 50 is modified so that section 52 includes a rim section and lug similar to rim 312 and lug 314, respectively, shown in FIG. 12.

The present invention provides a spur extension apparatus that can be used to arrange or position a bass drum so that the bass drum is substantially level when the bass drum is used with a drum lift. The spur extension of the present invention can be used with a variety of existing bass drum spurs. The spur extension of the present invention is portable, easily stored and easy to use. The spur extension of the present invention can be fabricated from a variety of materials. The size of the drum spur extension of the present invention can be varied to suit various sizes of pre-existing drum spurs, as well as the actual height adjustment required to set a bass drum at a level orientation when a drum lift is used with the bass drum.

It is to be understood that the invention is not limited to the illustrations described and shown herein, which are deemed to be merely illustrative of the best modes of carrying out the invention, and which are susceptible of modification of form, size, and arrangement of parts and details of operation. Rather, the invention is intended to encompass all such modifications which are within the spirit and scope as defined by the claims.

What is claimed is:

1. A drum spur extension apparatus comprising an elongate member having a predetermined length, a longitudinally extending axis and a longitudinally extending inner bore that is sized for receiving a drum spur, wherein the longitudinally extending inner bore is substantially coaxial with the longitudinally extending axis, the elongate member having a closed end and an opposite open end defining an opening in communication with the longitudinally extending inner bore, the elongate member further comprising an upper section, an intermediate section and a lower section wherein the inner bore is within the upper section, the lower section comprising the closed end, the intermediate section including external threads thereon, the drum spur extension apparatus further comprising a tip member attached to the elongate member such that the closed end of the lower section and at least a portion of the intermediate section is covered by the tip member, the tip member having an internal, threaded bore, wherein the tip member is threadedly engaged to the external threads on the intermediate section.

2. The drum spur extension apparatus according to claim 1 wherein the longitudinally extending inner bore is threaded.

3. The drum spur extension apparatus according to claim 1 further comprising:

a fastening device movably attached to the upper section of the elongate member, the fastening device having a first configuration wherein a portion of the fastening device extends into the longitudinally extending inner bore and a second configuration wherein the portion of the fastening device is not within the longitudinally extending inner bore;

wherein when a drum spur is disposed in the longitudinally extending inner bore and the fastening device is in the first configuration, the portion of the fastening device firmly contacts the drum spur to prevent the drum spur extension apparatus from sliding off of the drum spur; and wherein when the fastening device is in the second configuration, the portion of the fastening device is no longer in contact with the drum spur to allow the drum spur extension apparatus to move with respect to the drum spur.

4. The drum spur extension apparatus according to claim 3 wherein the fastening device comprises a lug.

5. The drum spur extension apparatus according to claim 3 wherein the upper section of the elongate member includes a rim and wherein the fastening device is movably engaged to the rim.

6. The drum spur extension apparatus according to claim 5 wherein the rim extends about the opening in the upper section.

7. The drum spur extension apparatus according to claim 5 wherein the elongate member is fabricated from metal.

8. The drum spur extension apparatus according to claim 1 wherein the tip member is fabricated from rubber.

* * * * *